US011772861B2

(12) United States Patent
Corning et al.

(10) Patent No.: US 11,772,861 B2
(45) Date of Patent: Oct. 3, 2023

(54) ANIMAL RESISTANT CANISTER

(71) Applicants: James Elmon Corning, Flagstaff, AZ (US); Helen Karen Jaleski, Flagstaff, AZ (US)

(72) Inventors: James Elmon Corning, Flagstaff, AZ (US); Helen Karen Jaleski, Flagstaff, AZ (US)

( * ) Notice: Subject to any disclaimer, the term of this patent is extended or adjusted under 35 U.S.C. 154(b) by 215 days.

(21) Appl. No.: 16/903,768

(22) Filed: Jun. 17, 2020

(65) Prior Publication Data

US 2020/0407132 A1 Dec. 31, 2020

Related U.S. Application Data

(60) Provisional application No. 62/867,633, filed on Jun. 27, 2019.

(51) Int. Cl.
*B65D 50/06* (2006.01)
*B65D 1/16* (2006.01)

(52) U.S. Cl.
CPC ..... *B65D 50/061* (2013.01); *B65D 1/16* (2013.01)

(58) Field of Classification Search
CPC .... B65D 50/061; B65D 45/327; B65D 45/28; B65D 39/12; B65D 2543/0049; B65D 2543/005; B65D 2543/00509; B65D 2543/00555; B65D 43/0229; B65D 43/0225; B65D 43/26; B65D 41/0478; B65D 41/0471; B65D 2255/20; B65D 55/022; B65D 51/18; B65D 39/08; B65D 25/02; B65D 43/0264; B65D 43/0266; B65D 43/0268; B65D 43/027; B65D 43/0272; B65D 43/0274; B65D 43/0227; B65D 43/0231; B65D 2215/00; B65D 2215/02; B65D 2215/04; B65D 55/12; B65D 50/04; B65D 50/02; B65D 50/06; Y10T 292/0854; Y10T 292/1077; Y10T 292/0861; Y10T 292/1039; Y10T 292/0852; F16L 55/136; F16L 55/132; F16L 55/1286; E05B 15/0093;
(Continued)

(56) References Cited

U.S. PATENT DOCUMENTS 969,776 A * 9/1910 Foley ..... E03B 9/10 70/168
969,881 A * 9/1910 Klemm ..... E03B 9/10 70/168

(Continued)

FOREIGN PATENT DOCUMENTS

GB 129540 A * 7/1919

*Primary Examiner* — Allan D Stevens
(74) *Attorney, Agent, or Firm* — Accelerate IP LLC

(57) ABSTRACT

An animal resistant canister having a canister body with a first end and second end and an inner wall and outer wall wherein the first end is open, and the second end is enclosed. A cap removably attachable to the first end, wherein the cap has an inner cap and an outer cap, the outer cap can have one or more dog supports coupled to the outer cap and one or more dogs wherein the dogs are coupled to the dog supports to allow the dogs to pivot about an axis. The inner cap is rotatable relative to the outer cap and can have one or more ramps that when the inner cap is rotated the ramps push the dogs outward towards the inner wall of the canister body when the inner cap is rotated relative to the outer cap.

12 Claims, 9 Drawing Sheets

(58) Field of Classification Search
CPC ..... E05B 65/5292; E05B 2047/0075; E05B 2047/0078
USPC ..... 220/730, 238; 215/330
See application file for complete search history.

(56) References Cited

U.S. PATENT DOCUMENTS

| | | | | | |
|---|---|---|---|---|---|
| 972,492 | A * | 10/1910 | Appleton | B65D 50/061 | 215/206 |
| 974,122 | A * | 11/1910 | Church | B65D 50/061 | 215/206 |
| 2,014,112 | A * | 9/1935 | McCord | E05B 35/06 | 70/168 |
| 2,792,963 | A * | 5/1957 | Smith | F16J 13/08 | 220/248 |
| 3,828,899 | A * | 8/1974 | Scott | E05B 65/5292 | 292/DIG. 48 |
| 4,223,799 | A * | 9/1980 | Eyster | B60K 15/0406 | 70/276 |
| 4,683,735 | A * | 8/1987 | Magrobi | B60K 15/0409 | 70/168 |
| 6,199,414 | B1 * | 3/2001 | Chang | E05B 65/006 | 292/49 |
| 7,572,372 | B2 * | 8/2009 | Graf | B65D 88/06 | 220/4.24 |
| 2013/0082201 | A1 * | 4/2013 | Condon | E03C 1/021 | 251/213 |

* cited by examiner

Section B-B

Section A-A

Section D-D

Section A-A

ANIMAL RESISTANT CANISTER

CROSS REFERENCE TO RELATED APPLICATION

This application claims benefit from U.S. Provisional Application No. 62/867,633 titled "Animal Resistant Canister" and having a filing date of Jun. 27, 2019 all of which is incorporated by reference herein.

FIELD OF THE INVENTION

The present specification relates to a canister, more particularly a canister for storing food that animals cannot open.

BACKGROUND OF THE INVENTION

Current animal canisters exist in the art to help keep items away from animals such as beards and rodents. When backpacking to store food safely away from animals such as bears and to keep these animals from eating or taking a backpacker's food, backpackers usually store their food in a sack high in a tree, or individuals have developed big, bulky canisters not suited for backpacking. Typically, these canisters are larger than a foot in diameter and require a key or some type of flat object to twist a lock to open the canister making these canisters very challenging to open. In certain cases, humans cannot even open the canister because the locks are too complicated or hard to open. These types of animal canisters are hard for backpackers to carry on their hikes and add weight and bulkiness to a backpack that is required to carry all the backpacker's necessities during the hike.

Therefore, there is a need for a device that is easy to transport and access by the user while still prohibiting animal access to the devices' contents.

BRIEF SUMMARY OF THE INVENTION

In embodiments an animal resistant canister can comprise a cap having an inner cap and an outer cap, a canister body having a first end and second end and an inner wall and outer wall wherein the first end is open and the second end is enclosed, the outer cap can further comprise one or more dogs and one or more dog supports wherein the dogs can be attached to the dogs supports by one or more pins and pivot around the pin's axis wherein the inner cap comprises one or more ramps that when the inner cap is rotated around its axis the ramps push the dogs outward towards the inner wall. The cap can be removably attached to the first end.

The animal resistant canister can have an outer cap that can further comprise an outer cap ring and the inner cap further comprises an inner cap ring wherein the outer cap ring supports the inner cap ring wherein the inner cap can rotate in the outer cap. The canister body can further comprise a striker fence wherein the dogs can contact the striker fence and keep the cap from unscrewing and being removed from the canister body. The inner cap can further comprise one or more indentations. The striker fence has a flat side wherein the dogs can come into contact with and act as an anti-rotation mechanism. The cap and the canister body are molded plastic with reinforced walls. The length of the animal resistant canister to its diameter is a ratio of at least 1.5 to 1.

A method of locking an animal resistant canister comprising the steps of attaching a removable cap onto a canister body, wherein the cap comprises an inner cap proximal to the axis of the canister and an outer cap peripheral to the inner cap, wherein the inner cap is rotatable relative to the outer cap and comprises one or more ramps that push one or more dogs outwards towards an inner wall of the canister body when the inner cap is rotated. Rotating the inner cap relative to the outer cap. Engaging the dogs with one or more striker fences on the inner wall of the canister body wherein the striker fence keeps the cap from rotating off of the canister body. Wherein the dogs are coupled to one or more dog supports on the outer cap to create an axis about which the dogs are free to pivot. A method of unlocking the animal resistant canister having a canister body with an inner wall and the canister further having a removable cap having an inner cap and an outer cap and wherein the cap is locked onto the canister body by one or more dogs coupled to the inner cap such that the dogs are free to pivot about an axis that is substantially perpendicular to the axis of the canister, wherein the dogs are engaged with one or more striker fences on the inner wall of the canister body such that the outer cap may not rotate relative to the canister when the dogs are engaged with the striker fences, the method comprising the steps of positioning the animal resistant canister to a substantially upright position. Rotating the inner cap to disengage the dogs from the striker fences and allowing the dogs to rotate with gravity and unscrewing the outer cap off of the canister body.

The method of locking and unlocking an animal resistant canister comprising of at least two actions, locking the animal resistant canister comprising, removably attaching a cap onto a canister body, rotating an inner cap within an outer cap wherein the inner cap comprises one or more ramps that push one or more dogs outwards towards an inner wall of the canister body, engaging the dogs with one or more striker fence on the inner wall of the canister body wherein the striker fence keeps the cap from rotating off of the canister body, wherein the dogs connect to one or more dog supports on the outer cap, unlocking the animal resistant canister comprising, positioning the animal resistant canister to the vertical direction with the cap facing up allowing the dogs to rotate with gravity, rotating the inner cap within the outer cap the opposite direction of the locking the animal resistant canister allowing the dogs to fall with gravity and release from the striker fences; and unscrewing the cap off of the canister body.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of molding a fishing lure, without also reciting in such phrases any structure, material or act in support of the function. Thus, even when the claims recite a "means for performing the function of molding a fishing lure, step for performing the function of molding a fishing lure," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

FIG. 6*a* top view of the canister body of the animal resistant canister in accordance to one, or more embodiments;

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Referring initially to FIGS. 1-4, an animal resistant canister is shown generally at 10. An animal resistant canister 10 can comprise a cap 20 and a canister body 60 wherein the cap can be removably attached to the canister body.

Figure 7:
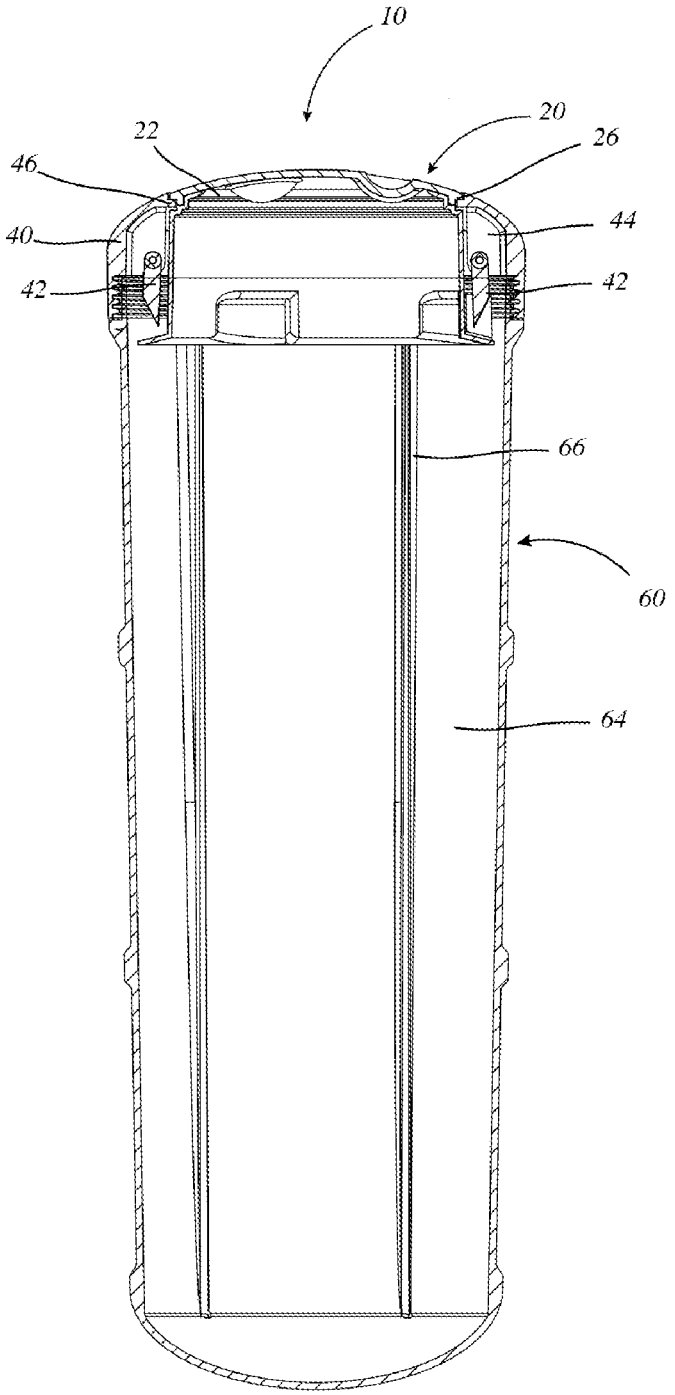
FIG. 7 is a cross-section view taken along line A-A of FIG. 2*a* with dogs dis-engaged of the animal resistant canister in accordance to one, or more embodiments.

Referring to FIG. 5 the cap 20 comprising an inner cap 22 and an outer cap 40 wherein the inner cap 22 can rotate freely within the outer cap 40. The inner cap can comprise an inner cap ring 26 and the outer cap 40 can comprise an outer cap ring 46. The inner cap ring 26 can accept the outer cap ring 46 allowing for the inner cap 22 to freely rotate within the outer cap 40 as shown in FIG. 7. The inner cap 22 can further comprise at least one or more ramps 24 wherein the ramps can be spaced axially around the outside perimeter of the inner cap. The ramps 24 can be equally or unequally spaced axially around the outside perimeter of the inner cap 22. The ramps 24 can gradually increase in diameter or size as it rotates around the outer perimeter of the inner cap 22. The inner cap 22 can be open on the inner side and enclosed on the outer side. The cap can be manufactured as one or more pieces wherein the cap can have a top 30 wherein at least one or more indentations 28 can be equally or unequally spaced on the outer side of the top. The indentations 28 can be circular, square, rectangular, or the like in shape and can allow a user to easily turn the inner cap within the outer cap 40. In some embodiments the indentation can be omitted. The cap 20 can be dome shaped having a radius of curvature that is about the same diameter as the canister body 60 as shown in FIG. 7. In certain embodiments the cap 20 can vary in shape and size to accommodate the canister body's shape and size. The cap 20 can be manufactured from materials such as, but not limited to, molded plastics, steels, aluminum, ceramics, carbon filled material, or the like.

The outer cap 40 can further comprise at least one or more dogs 42 wherein the dogs can be attached to at least one or more dog supports 44 by at least one or more pins 50. The dog supports 44 can be attached and equally unequally spaced to the inner circumference of the outer cap 40. The dog supports 44 allow the dogs to freely rotate about the pin's 50 axis. The pins 50 hold the dogs 42 into position and let the dogs 42 rotate with gravity wherein when the animal resistant canister is held vertically the dogs hang freely pointing towards the bottom of the container and if the animal resistant canister is held horizontally the dogs hang towards the canister body's 60 inner wall 64 or the inner cap's 22 outer wall. The dogs supports 44 and pins 50 can allow the dogs 42 to freely rotate about the pin's axis. The dogs 42 can be rectangular, oval, circular, or the like in shape having a radius on one end and an angle on the other and can be manufactured from, but not limited to, steel, plastic such as polymers, polycarbonate, or aluminum, polymer matrix, carbon fiber, nylon, or the like. The inner circumference of the outer cap 40 can be threaded 48 allowing for the cap 20 to rotate onto the canister body 60 as shown in FIG. 7. The dogs 42 can ride on the ramps 24 wherein as the inner cap rotates within the outer cap 40 the dogs are pushed outwards towards the inner wall of the outer cap and put into a locked into position. As the inner cap 22 rotates the opposite direction the dogs 42 are able to ride back down the ramp 24 and rotate freely on the pin 50 into an unlocked position.

Figure 1:
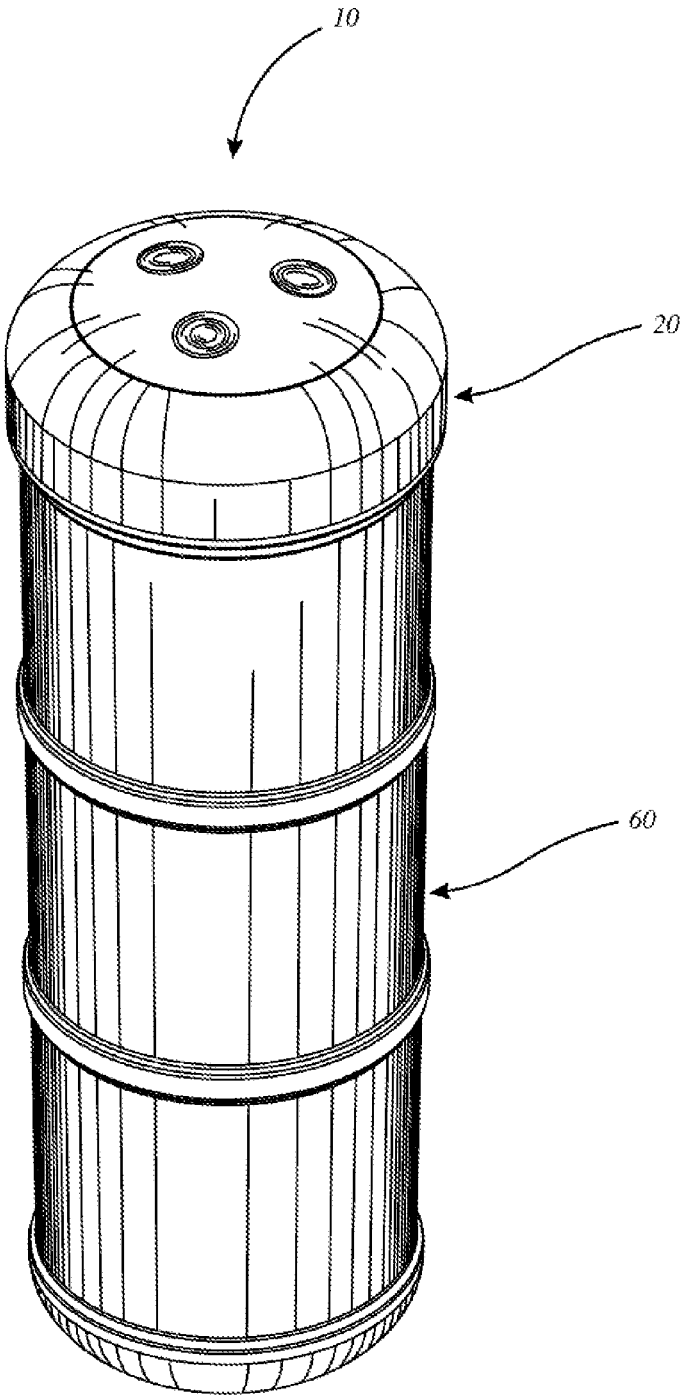
FIG. 1 is an isometric view of the animal resistant canister in accordance to one, or more embodiments.
Figure 2A:
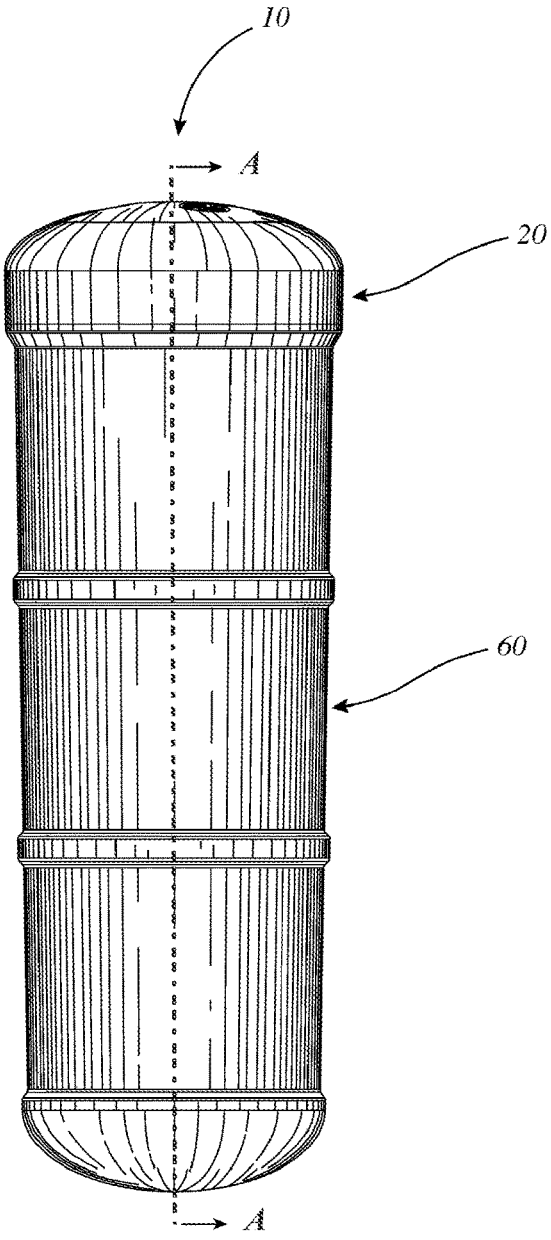
FIG. 2*a* is a front view of the animal resistant canister in accordance to one, or more embodiments.
Figure 2B:
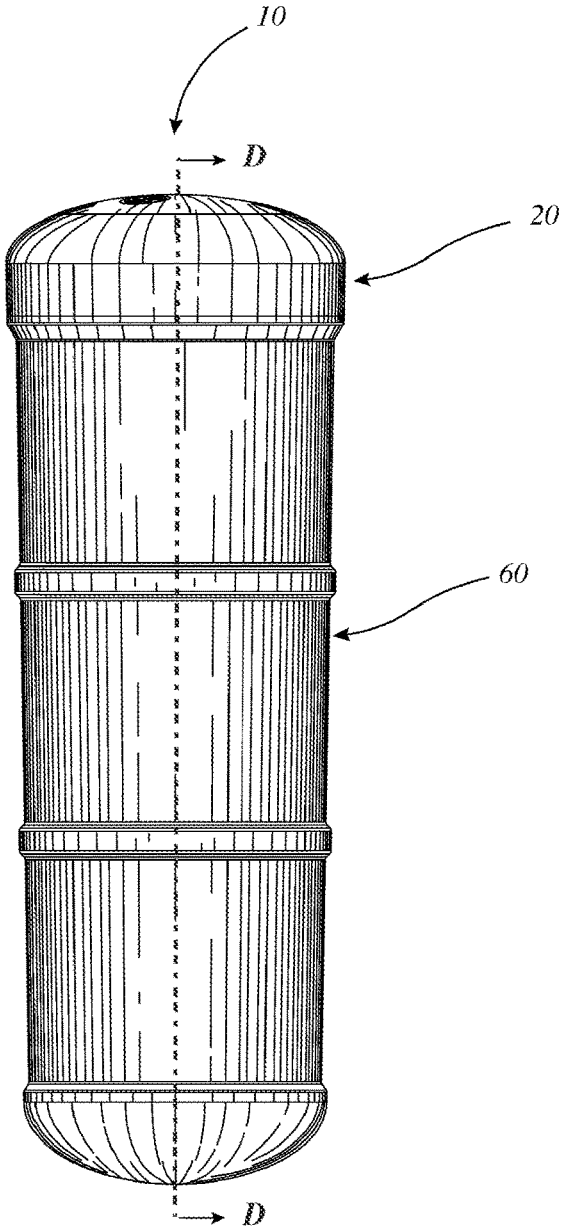
FIG. 2*b* is a front view of the animal resistant canister in accordance to the embodiment of FIG. 2*a* with the inner cap rotated relative to the outer cap.
Figure 3:
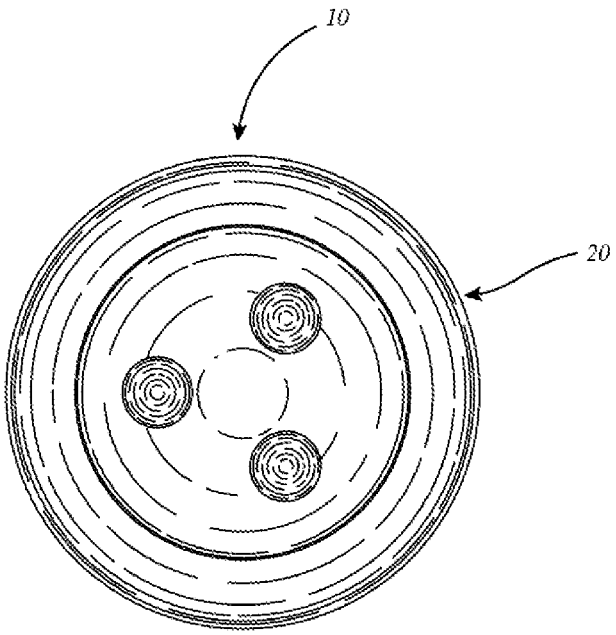
FIG. 3 is a top view of the animal resistant canister in accordance to one, or more embodiments.
Figure 4:
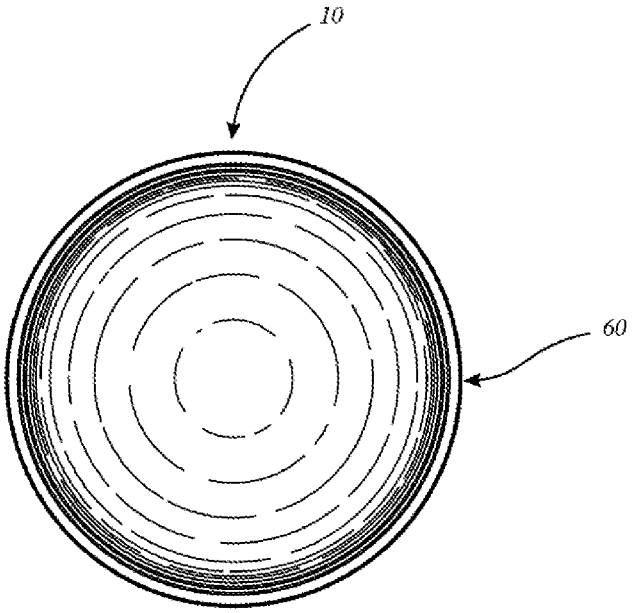
FIG. 4 is a bottom view of the animal resistant canister in accordance to one, or more embodiments.
Figure 5B:
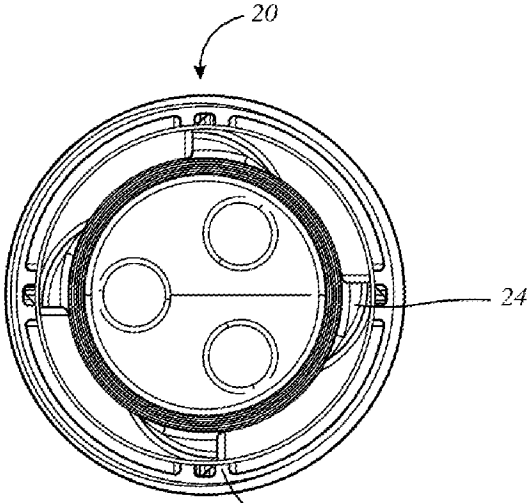
FIG. 5*b* is a bottom view of the cap assembly of the animal resistant canister in accordance to one, or more embodiments.
Figure 5D:
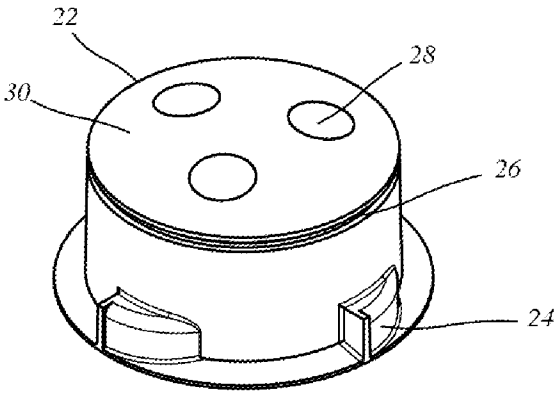
FIG. 5*d* is a isometric view of the inner cap of the animal resistant canister in accordance to one, or more embodiments.
Figure 5A:
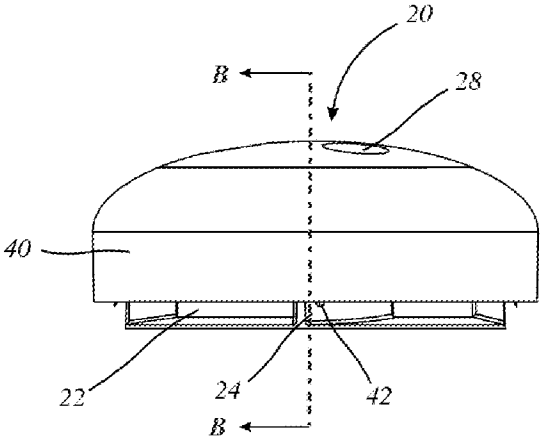
FIG. 5*a* is a side view of the cap assembly of the animal resistant canister in accordance to one, or more embodiments.
Figure 5C:
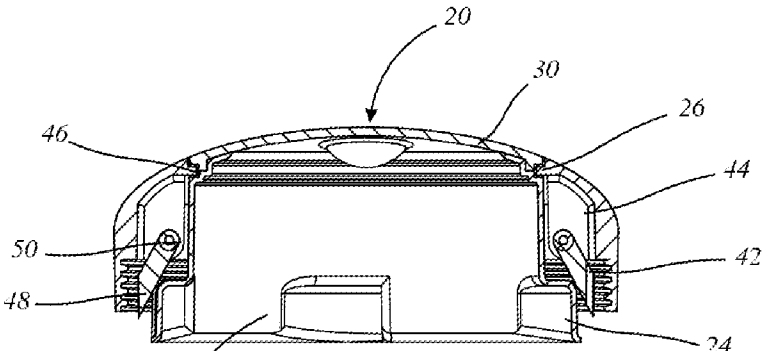
FIG. 5*c* is a cross-sectional view taken along line B-B of FIG. 5*a* of the cap assembly of the animal resistant canister in accordance to one, or more embodiments.
Figure 6A:
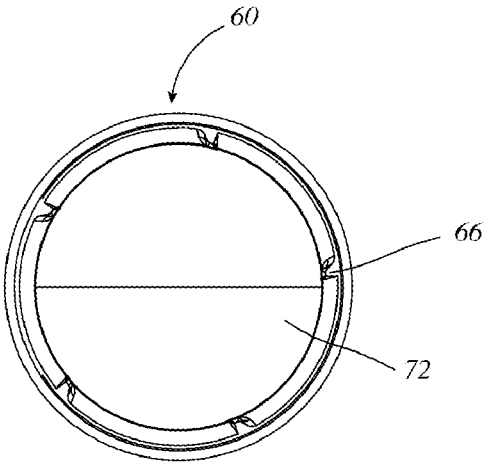
Figure 6B:
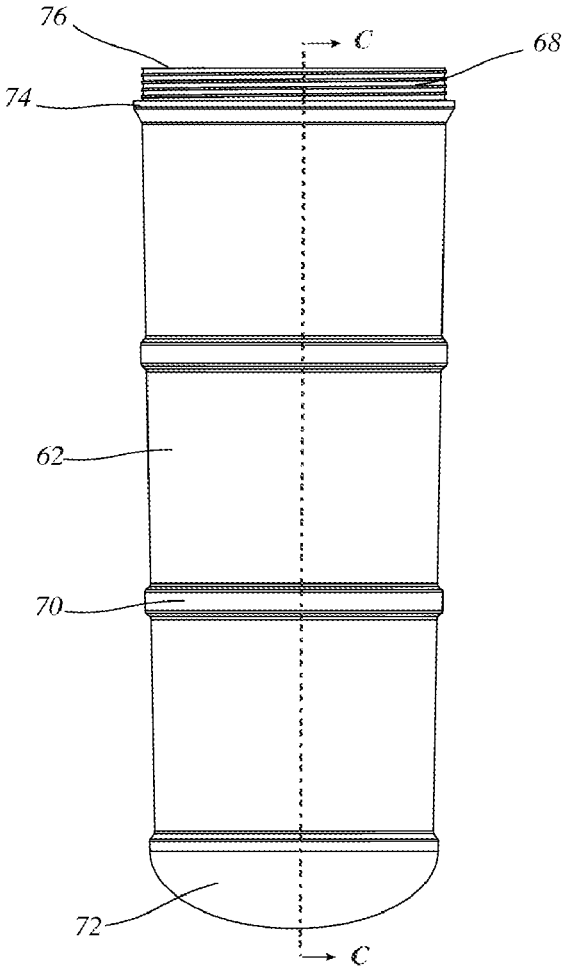
FIG. 6*b* is a side view of the canister body of the animal resistant canister in accordance to one, or more embodiments.
Figure 6C:
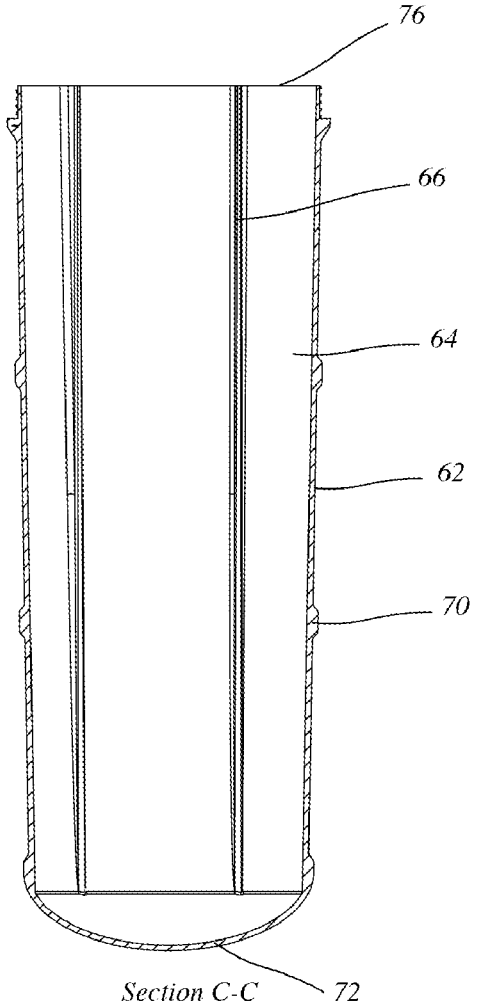
FIG. 6*c* is a cross-sectional view taken along line C-C of FIG. 6*b* of the canister body of the animal resistant canister in accordance to one, or more embodiments.

Referring to FIG. 6 the canister body 60 can comprise an outer wall 62, an inner wall 64 having a first end 76 and a second end 72 wherein the first end can have an opening to accept the cap 20, as shown in FIG. 7, and the second end can be enclosed. The inner wall 64 can have at least one or more striker fence 66 extending axially toward the center of the canister body 60. The striker fence 66 can extend perpendicularly from the first end 76 to the second end 72, and in certain embodiments the striker fence 66 can extend partially from the first end 76 to the second end 72. The striker fence 66 can be a 90-degree triangle with a flat edge or it can be for example, a square, a rectangle, an oval, or the like in shape. The canister body 60 can be a tubular shape that tapers gradually down to the second end 72 or the taper can be omitted, and the canister body can be substantially cylindrical. In certain embodiments the canister body 60 can be in the shape of a circle, square, oval, rectangular, or the like and can taper or vary in size from the first end 76 to the second end 72. The canister body 60 diameter can be for example, between 3 inches and 18 inches, more preferably between 5 inches and 12 inches, and still more preferably a diameter of 7 inches or the like. The canister body 60 length can be for example, between 8 inches and 30 inches, more preferably a length between 12 inches and 24 inches, and still more preferably a length of 18 inches or the like.

The canister body 60 can have threads 68 on the outer circumference of the first end 76 and a cap stop 74 that keeps the cap 20 from being threaded past the cap stop and create a seal between the outer cap 40 and the canister body 60. The threads 68 can be Acme threads, plastic bottle threads, national pipe thread ("NPT") threads, machine screw threads, or the like. The outer wall 62 can further comprise one or more wall reinforcement 70 wherein the wall reinforcement wraps around the outer wall 62. The canister body 60 wherein the aspect length to diameter ratio of the canister body can be at least 1.5 to 1, 2 to 1, 3 to 1, 4 to 1, or the like. The overall length of the animal resistant canister 10 can be made to fit into a common backpack compartments and suited for varying requirements for food carrying capacity.

Figure 8:
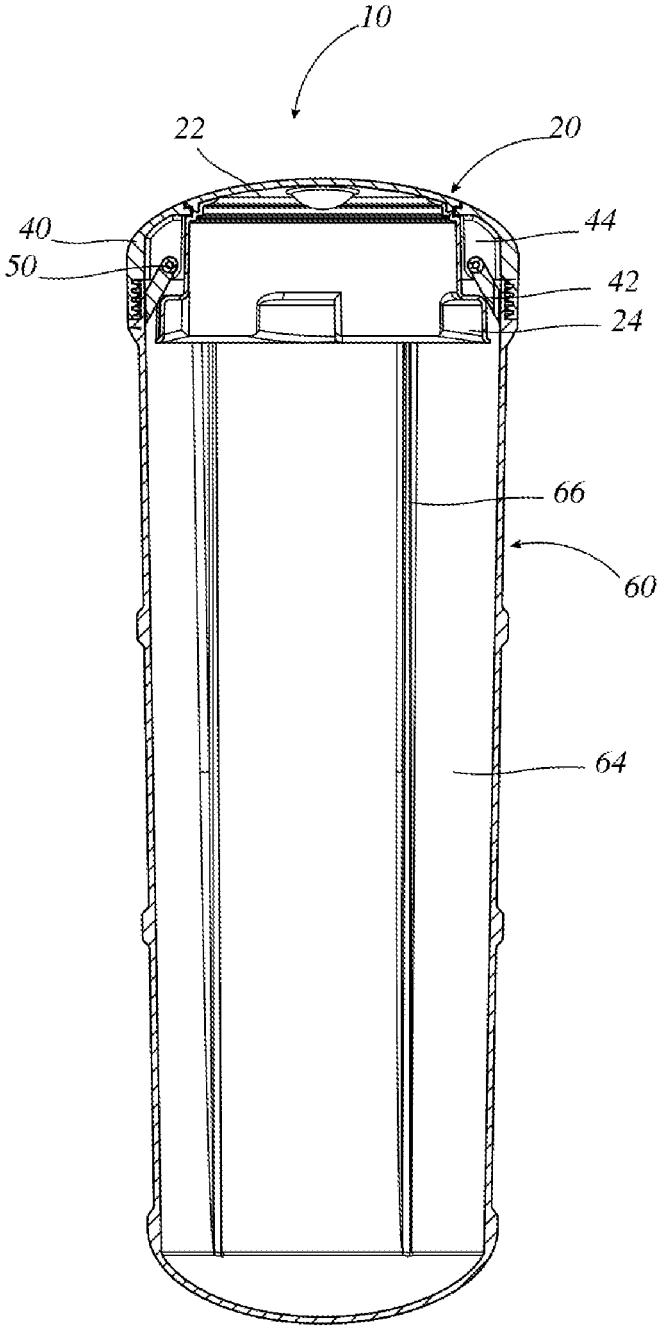
FIG. 8 is a cross-section view taken along line D-D of FIG. 2*b* with dogs engaged.

Referring to FIGS. 7-8 the cap 20 can be removably attached to the canister body 60 by threading the cap onto the canister body. In certain embodiments the cap 20 can be removably attached to the canister body by tongue and groove, clamps, push to connect, couplings or the like. When attaching the cap 20 onto the canister body 60 the cap will be in the unlocked position to allow the cap to fully engage the canister body as shown in FIG. 7. Once the cap 20 is fully engaged onto the canister body 60 the inner cap 22 can rotate on the outer cap 40 extending the dogs 42 outwards towards the inner wall 64 of the canister body as shown in FIG. 8. The dogs 42 will contact the flat edge of the striker fence 66 keeping the cap 20 from rotating off of the canister body 60. To remove the cap 20 from the canister body 60 the inner cap can rotate to its unlocked position allowing the dogs 42 to disengage from the striker fence 66 and hang freely with the effects of gravity so that the user can rotate the cap off of the canister body.

Figure 9:
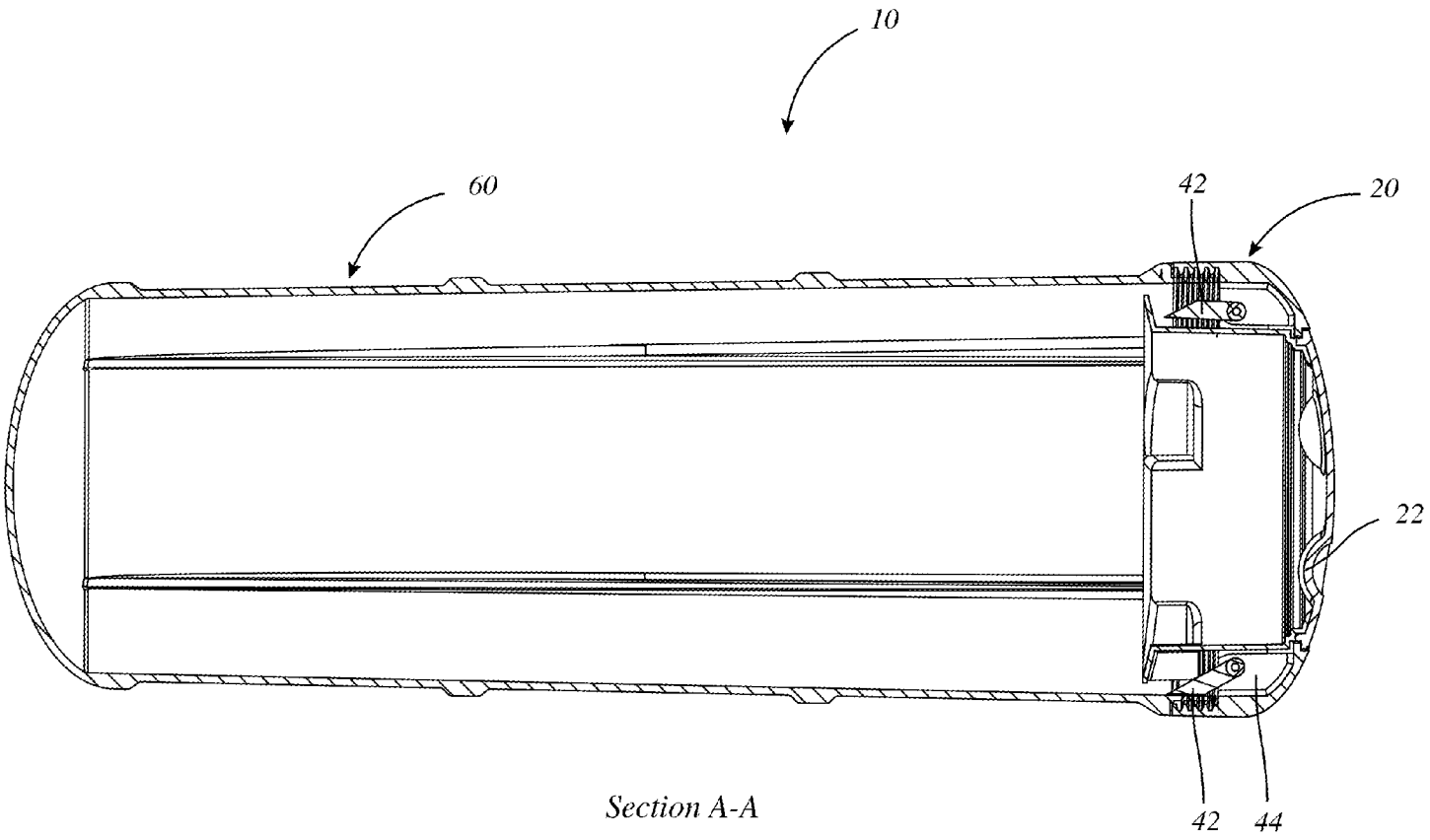
FIG. 9 is a cross-section view taken along line A-A of FIG. 2*a* of the animal resistant canister sitting horizonal with at least one dog engaged.

The animal resistant canister 10 can have a two-part locking action to keep animals from getting into the animal resistant canister's contents. To lock the animal resistant canister 10 a user can screw the cap onto the canister body. The user can rotate the inner cap within the outer cap to a locked position which can push the dogs 42 outwards toward the inner wall 64 of the canister body 60. If the user tries to unlock the animal resistant canister the dogs 42 will come into contact the striker fence 66 and keep the cap from rotating off of the canister body 60. To unlock the animal resistant canister 10 the user can hold the animal resistant canister vertically with the cap 20 facing vertically, the inner cap 22 can be rotated within the outer cap 40 to the unlock position allowing for the dogs 42 to pivot back to their unlocked state allowing the cap 20 to freely unscrew from the canister body 60. If the animal resistant canister 10 is held in the horizontal position and the inner cap 22 is in its unlocked state gravity acts on the dogs 42 and one or more dog can fall to inner wall 64 of the canister body 60 and can come into contact with one or more sticker fences 66 keeping the cap from rotating and unlocking as shown in FIG. 9.

In embodiments a method of locking an animal resistant canister can comprise the steps of attaching a removable cap onto a canister body, wherein the cap comprises an inner cap proximal to the axis of the canister and an outer cap peripheral to the inner cap, wherein the inner cap is rotatable relative to the outer cap and comprises one or more ramps that push one or more dogs outwards towards an inner wall of the canister body when the inner cap is rotated. The inner cap can rotate relative to the outer cap. The dogs can engage with one or more striker fences on the inner wall of the canister body wherein the striker fence keeps the cap from rotating off of the canister body. The dogs can be coupled to one or more dog supports on the outer cap to create an axis about which the dogs are free to pivot. A method of unlocking the animal resistant canister having a canister body with an inner wall and the canister further having a removable cap having an inner cap and an outer cap and wherein the cap is locked onto the canister body by one or more dogs coupled to the inner cap such that the dogs are free to pivot about an axis that is substantially perpendicular to the axis of the canister, wherein the dogs are engaged with one or more striker fences on the inner wall of the canister body such that the outer cap may not rotate relative to the canister when the dogs are engaged with the striker fences, the method comprising the steps of positioning the animal resistant canister to a substantially upright position. Rotating the inner cap to disengage the dogs from the striker fences and allowing the dogs to rotate with gravity and unscrewing the outer cap off of the canister body.

Figure 10:
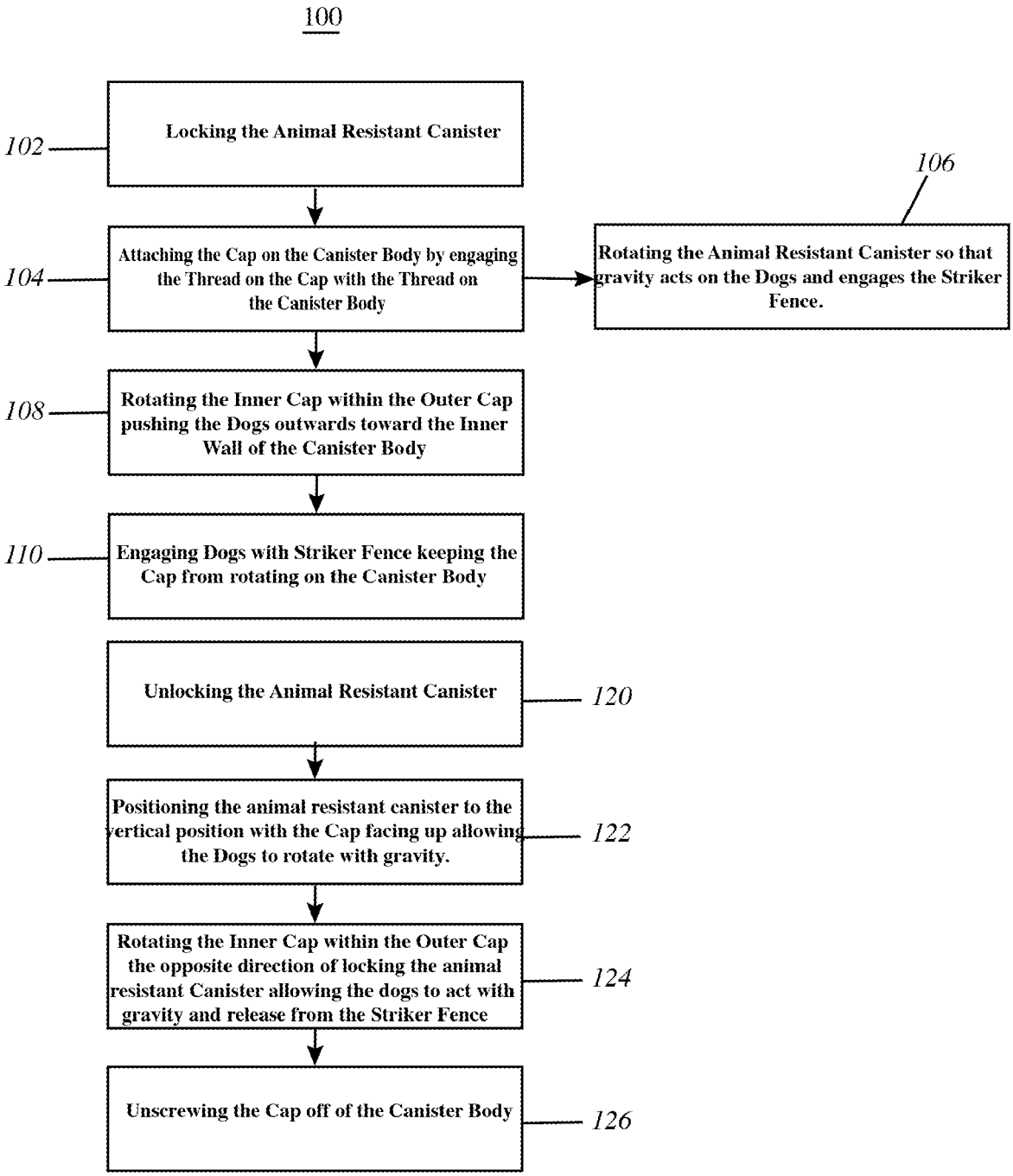
FIG. 10 a flow chart showing the method of unlocking and locking the animal resistant canister in accordance to one, or more embodiments.

Referring to FIG. 10, a method of locking the animal resistant canister at step 100. At step 102 locking the animal resistant canister comprises attaching the cap on the canister body by engaging the thread on the cap with the thread on the canister body at step 104. Rotating the inner cap within the outer cap wherein the inner cap pushes the dogs outward towards the inner wall of the canister body at step 108. At step 106 rotating the animal resistant canister so that gravity acts on the dogs and engages the striker fence wherein the animal resistant canister can have secondary locking system if the inner cap does not engage the dogs outward. At step 110 engaging the dogs with the striker fence keeping the cap from rotating on the canister body. At step 120, unlocking the animal resistant canister comprising, positioning the animal resistant canister to the vertical position with the cap facing up which will allow the dogs to rotate with gravity at step 122. Rotating the inner cap within the outer cap the opposite direction of the locking the animal resistant canister allowing the dogs to act with gravity and the dogs can be released from the striker fence at step 124. Unscrewing the cap off of the canister body at step 126.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. An animal resistant canister comprising:

a canister body having an open first end and an enclosed second end, an inner wall, an outer wall and at least one striker fence;

a cap removably attachable to the first end, wherein the cap comprises one or more dog supports and wherein each of the one or more dog supports supports a dog that is able to pivot about the dog's respective dog support from a locked position in which the dog prevents the cap from completing a full 360° rotation by extending to contact the at least one striker fence when the cap is rotated relative to the canister body, to an unlocked position in which the dog does not extend to contact the striker fence when the cap is rotated relative to the canister body.

2. The animal resistant canister according to claim 1, wherein the at least one striker fence has a flat side and wherein contact between the flat side and one of the one or more dogs is configured to stop the cap from rotating off of the canister body when the at least one of the one or more dogs is in the locked position.

3. The animal resistant canister according to claim 1, wherein the canister body is molded plastic with reinforced walls.

4. The animal resistant canister according to claim 1, wherein the length of the animal resistant canister to its diameter is a ratio of at least 1.5 to 1.

5. The animal resistant canister according to claim 1, wherein the cap comprises an inner cap situated within and rotatable relative to an outer cap.

6. The animal resistant canister according to claim 5, wherein the inner cap rotates relative to the outer cap through use of an outer cap ring coupled to the outer cap and an inner cap ring coupled to the inner cap.

7. The animal resistant canister according to claim 5, wherein the inner cap further comprises one or more indentations configured to facilitate rotation of the inner cap relative to the outer cap by a user.

8. The animal resistant canister according to claim 5, wherein the inner cap comprises one or more ramps that push at least one of the one or more dogs from the unlocked position to the locked position.

9. The animal resistant canister according to claim 8, wherein the inner cap rotates between a double lock open position in which none of the one or more ramps is engaging at least one of the one or more dogs into the locked position and a double lock closed position in which at least one of the one or more ramps is engaging at least one of the one or more dogs into the locked position.

10. The animal resistant canister according to claim 1, wherein at least one of the one or more dogs is in the locked position unless the canister is held in an upright position.

11. The animal resistant canister according to claim 10, wherein moving the canister out of the upright position has the effect of gravity extending at least one of the one or more dogs into the locked position.

12. The animal canister according to claim 1, wherein the at least one striker fence is five evenly spaced striker fences and wherein the dog prevents the cap from completing 70° of rotation by extending to contact one of the at least one striker fences when the cap is rotated relative to the canister body when the dog is in the locked position.

* * * * *